US007162784B2

(12) United States Patent
Wagner

(10) Patent No.: US 7,162,784 B2
(45) Date of Patent: Jan. 16, 2007

(54) APPARATUS AND METHOD FOR CHANNELIZER DRUM REFORMER

(76) Inventor: Jeffrey P. Wagner, 1357 E. 400 North, Greenfield, IN (US) 46140

( * ) Notice: Subject to any disclaimer, the term of this patent is extended or adjusted under 35 U.S.C. 154(b) by 232 days.

(21) Appl. No.: 10/852,023

(22) Filed: May 24, 2004

(65) Prior Publication Data

US 2004/0244171 A1 Dec. 9, 2004

Related U.S. Application Data

(60) Provisional application No. 60/475,690, filed on Jun. 5, 2003.

(51) Int. Cl.
*B21D 1/00* (2006.01)
*B23P 6/00* (2006.01)
*C12C 11/00* (2006.01)

(52) U.S. Cl. ..... 29/402.19; 29/402.01; 426/11

(58) Field of Classification Search ..... 29/402.19, 29/402.01; 135/20.3, 15.1, 22, 25.31; 426/11, 426/383, 392, 393
See application file for complete search history.

(56) References Cited

U.S. PATENT DOCUMENTS

| | | | | |
|---|---|---|---|---|
| 2,782,795 | A * | 2/1957 | Small | 135/20.3 |
| 3,129,715 | A * | 4/1964 | Miltano et al. | 135/20.3 |
| 4,710,053 | A | 12/1987 | Kulp et al. | |
| 5,234,280 | A | 8/1993 | Cowan | |
| 6,685,857 | B1 * | 2/2004 | Dowling et al. | 264/36.15 |

* cited by examiner

*Primary Examiner*—John C. Hong
(74) *Attorney, Agent, or Firm*—Paul B. Overhauser; Overhauser Law Offices, LLC

(57) ABSTRACT

An apparatus and method for reforming deformed drums. Deformed drums are placed over an apparatus that expand a series of arms as a user exerts a force generally downward and outward along a sliding axis of a central mast. The apparatus is secured to a rigid mount that allows sufficient forces to be applied to the deformed drum that allow the device to reshape to a usable form. The apparatus is portable enough such that it can easily be mounted to a movable platform, for example, a construction vehicle with a typical square receiver trailer hitch.

13 Claims, 12 Drawing Sheets

APPARATUS AND METHOD FOR CHANNELIZER DRUM REFORMER

RELATED PROVISIONAL APPLICATION

This application claims priority from U.S. Provisional Patent Application No. 60/475,690 filed 5 Jun. 2003.

BACKGROUND OF THE INVENTION

1. Field of Invention

This invention relates to the reforming of deformed channelizer drums as used in road construction or maintenance. Such drums are often deformed when impacted by vehicular traffic in construction zones.

2. Description of Related Art

Channelizer drums are used to indicate a path for motorists during road construction or maintenance. Due to the close proximity to vehicles, these drums are routinely deformed during impact with said vehicles. The drums are designed to be reformed after an impact. If a drum is lightly deformed, it can generally be reformed by rolling it along the ground using ones hands to reshape the drum. If the drum is more severely deformed, it requires an increased effort using other methods. These methods may include kicking the drum from the inside, beating the inside of the drum with a shovel, lumber or similar object. If the damage is severe, the drum is generally discarded. Thus, it would be desirable to provide a system to quickly reform all conditions of said channelizer drums.

A typical channelizer drum used in the United States is tapered from an upper diameter of approximately 18 inches to a lower diameter of approximately 20 inches with a height of approximately 40 inches. The top of a channelizer drum is closed and includes a handle and mounting holes for use with lights or other devices. The drums are often made of low or high density polyethylene polymers and are wrapped with bands reflective sheeting. Typical channelizer traffic control devices are disclosed in U.S. Pat. Nos. 4,710,053 and 5,234,280. The bottom of a channelizer drum is open when not attached to a ballasted base. There exist many slight variations to this basic shape, but for the purposes of this invention, this approximate configuration will be assumed.

Each of the shown and discussed embodiments of this invention relate to the mounting of said invention to a rigid mounting structure, such as a motor vehicle. One mounting system illustrated and described is a typical square trailer hitch mounting system. A typical trailer hitch receiver is disclosed in U.S. Pat. No. 3,768,837.

SUMMARY OF THE INVENTION

It is a principal object of the present invention to provide an apparatus and method for reforming deformed drums. Deformed drums are placed over an apparatus that expand a series of arms as a user exerts a force generally downward and outward along a sliding axis of a central mast. The apparatus is secured to a rigid mount that allows sufficient forces to be applied to the deformed drum that allow the device to reshape to a usable form. The apparatus is portable enough such that it can easily be mounted to a movable platform, for example, a construction vehicle with a typical square receiver trailer hitch. Of course, one skilled in the art would readily know and understand that many other rigid mounting systems exist and could be used while maintaining the scope of the invention.

It is a further object of the invention to provide an apparatus and method that allows a worker the capability to perform the reforming near the site where the deforming occurred.

It is a further object of the invention to provide an apparatus and method that allows for adjustment of the apparatus to allow for various worker heights and mounting heights. An optimal ergonomic height generally exists for a worker to exert a force along a generally outward and downward direction. Various workers and mounting heights make it desirable for the apparatus to accommodate these variations.

It is a further object of the invention to provide an apparatus and method that allows a worker to exert a nominal force to accommodate reforming. Existing equipment include typical construction tools, for example, a shovel, a hammer, a board, or a pipe. When used in conjunction with typical worker actions, for example, pulling or kicking, reforming can require significant effort. It is also generally understood that exerting considerable effort for an extended period of time is undesirable. Often, if a worker is given the choice of exerting considerable effort to reform a deformed drum versus replacing it, the worker will often choose to replace it.

It is a further object of the invention to provide an apparatus and method for reforming deformed channelizer drums in a safer and in a generally improved ergonomic manner. Related to the object of providing an apparatus and method that allows a worker to exert a nominal force to accommodate reforming, a reduction in stress can be inferred from using the invention versus the awkward motions described previous. For example, trying to place one leg inside a deformed drum and trying to kick out the deformations, is generally understood to be non-ergonomic and potentially unsafe.

It is a further object of the invention to provide an apparatus that can provide additional reduction in worker effort by the adding a power-assisting capability. One embodiment of the invention utilizes and external power source to increase the power advantage of the invention. One such source, for example, could be a pneumatic compressor.

It is a further object of the invention to provide an apparatus that includes a power-assisting capability that allows for simple and efficient to control of the external power source.

It is a further object of the invention to provide an apparatus that includes a power-assisting capability that can still function in a manual-mode if the power source for said power-assisting device is unavailable.

It is a further object of the invention to provide an apparatus and method that allows for minimal additional damage to the channelizer drum during reforming. In one existing method of reforming, it requires a worker to roll a deformed drum along a generally flat surface while pressing down on the deformed drum. Often the surface consists of typical road construction debris, for example, rocks, dirt, asphalt, or concrete. These surfaces can have a negative affect on the reflective surface of the channelizer drum. The invention enables reforming from the interior of the drum and typically does not negatively impact the reflective sheeting on the exterior of the drum.

It is a further object of the invention to provide an apparatus and method for reforming deformed channelizer drums that would previously be discarded due to the costly labor intensive method to reform said drums. High labor costs of skilled construction workers can imply that a specific amount of time be dedicated to reforming a deformed drum. If an excessive amount of time is required to reform the drum, it is financially advantageous to discard the drum and replace it with a new drum.

It is a further object of the invention to provide an apparatus is generally self-contained and easily transportable.

It should also be noted that this invention is generally described as to how it pertains to a channelizer drum, but it could also be suitably used to reform similarly shaped devices, such as a typical flexible polymer trash can, for example.

BRIEF DESCRIPTION OF THE DRAWINGS

Various exemplary embodiments of the systems and methods of this invention will be described in detail with reference to the following figures, wherein.

DETAILED DESCRIPTION OF EXEMPLARY EMBODIMENTS

Figure 1:
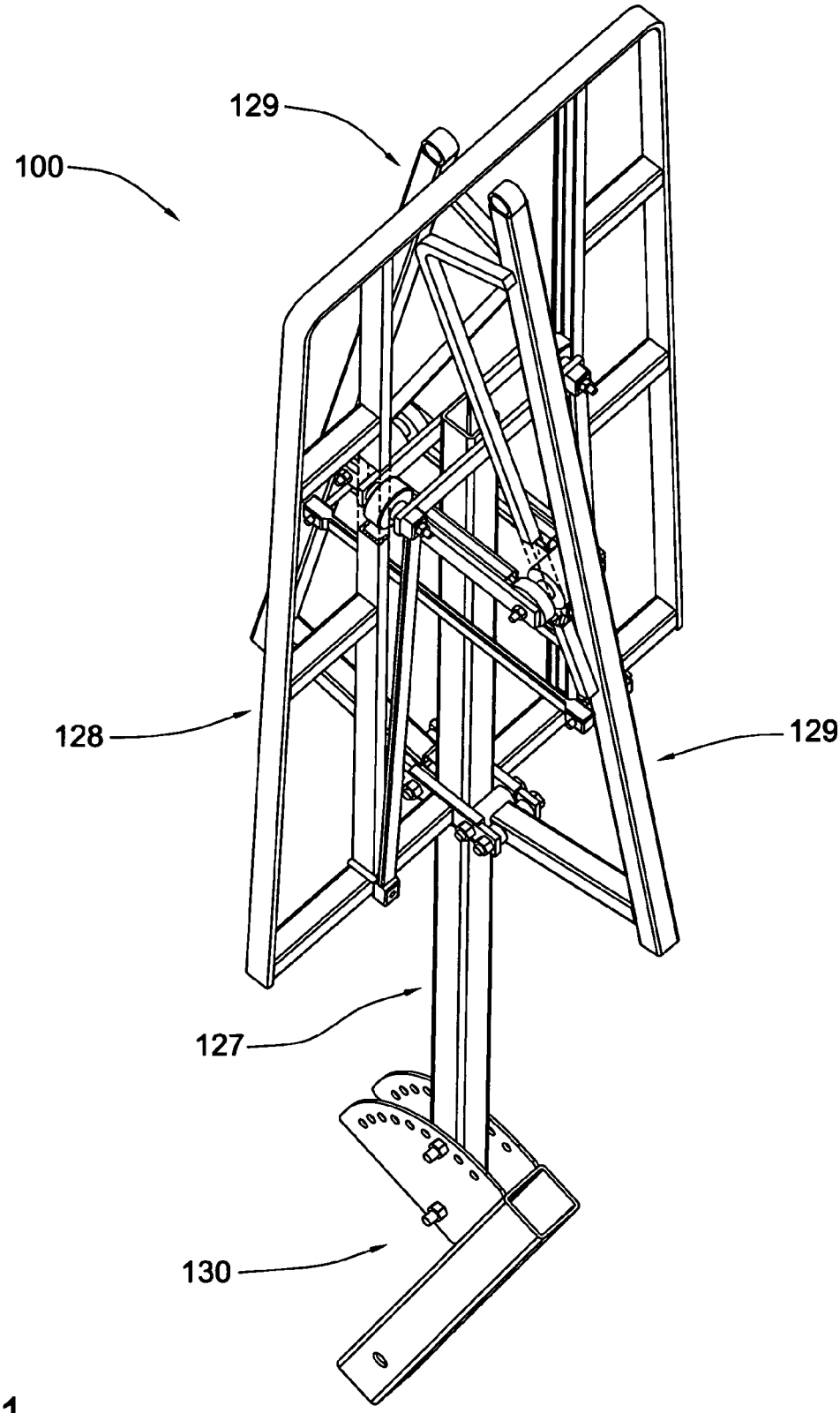
FIG. 1 illustrates a perspective view of a first exemplary embodiment of the channelizer drum reformer according to the invention in a retracted mode.
Figure 2:
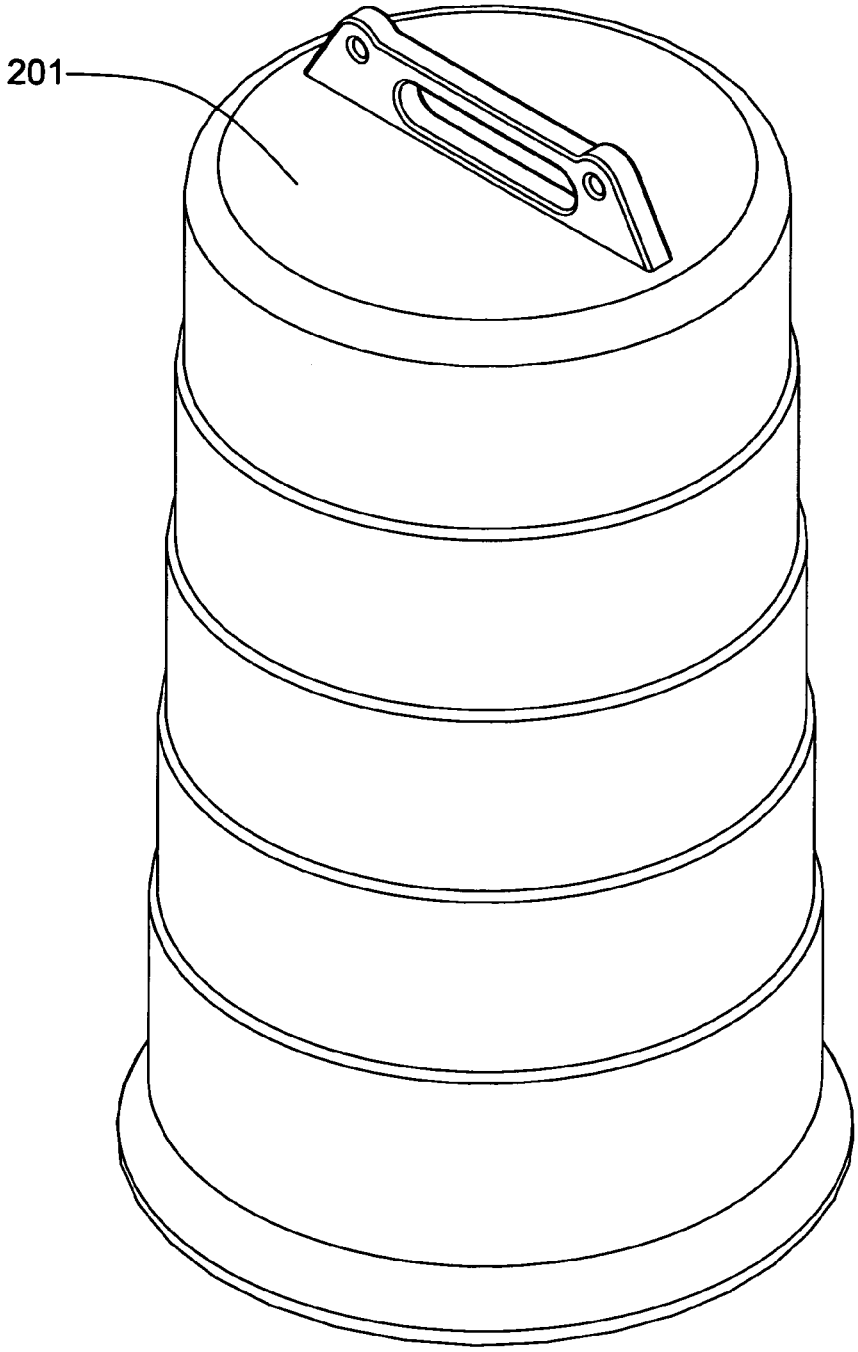
FIG. 2 (prior art)
FIG. 2 illustrates a perspective view of a typical non-deformed channelizer.
Figure 3:
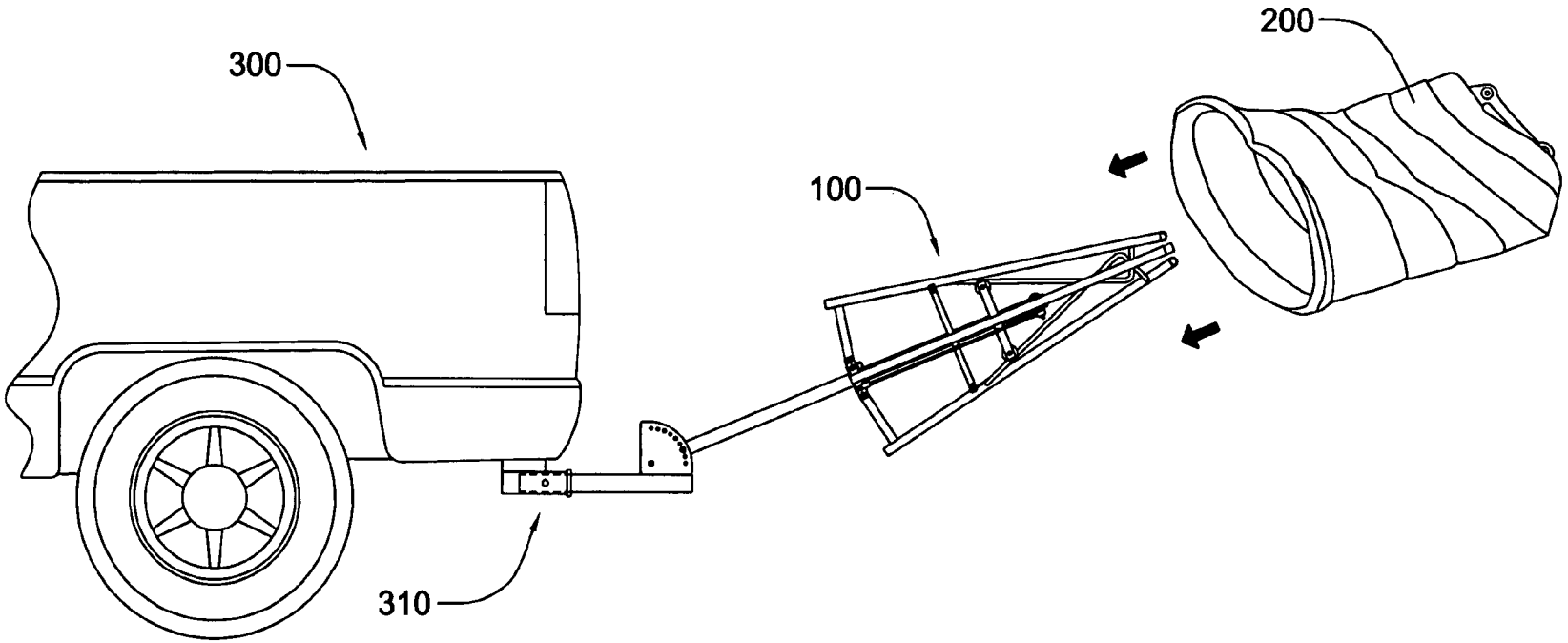
FIG. 3 illustrates a side elevation view of a first exemplary embodiment in conjunction with a vehicle and showing an approximate direction of placing a deformed channelizer drum onto the invention.
Figure 4:
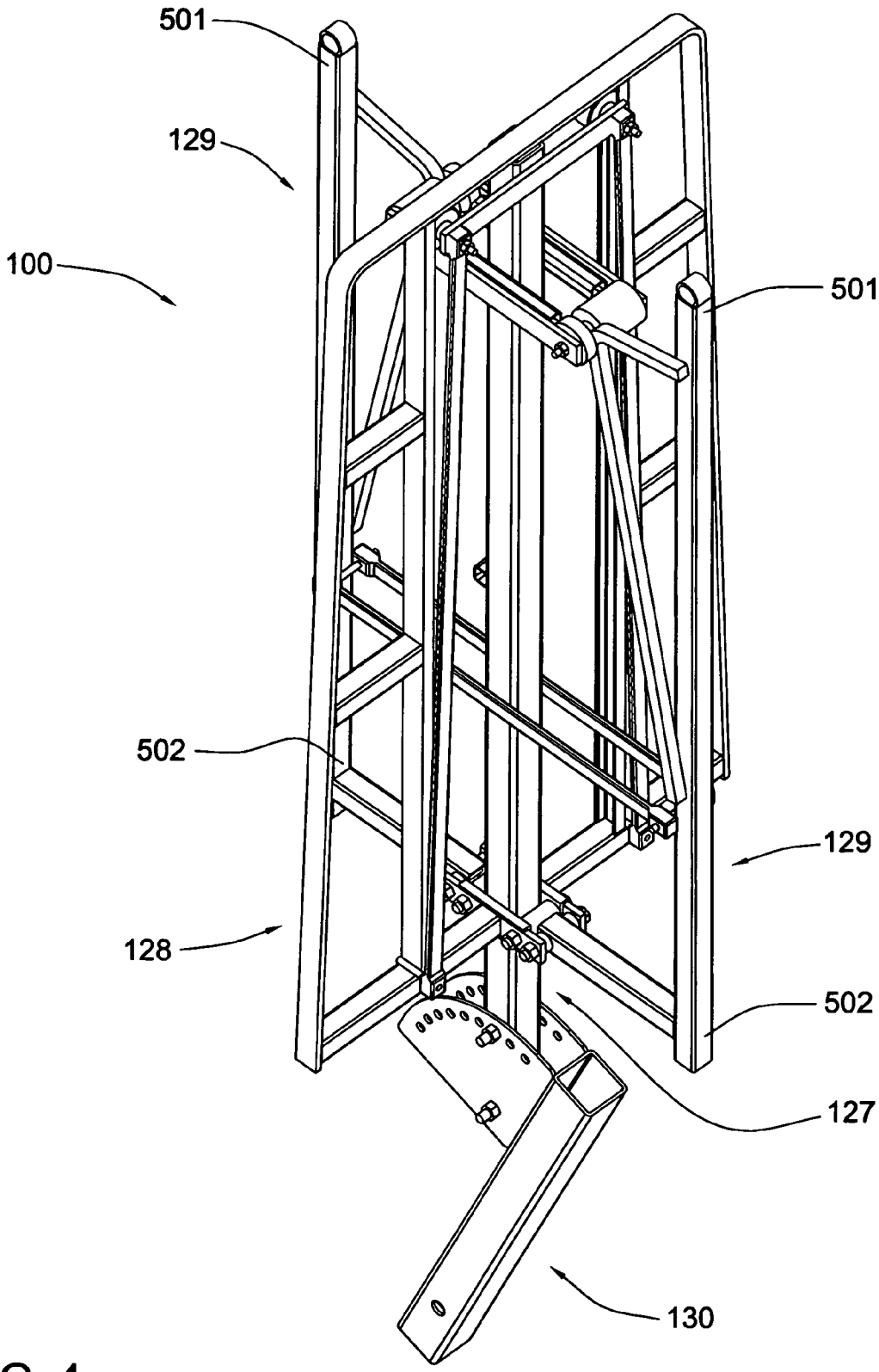
FIG. 4 illustrates perspective view of a first exemplary embodiment similar to FIG. 1, except in an expanded mode according to the invention.

Referring now to FIGS. 1–11, wherein the showings are for purposes of illustrating certain preferred embodiments of the invention only and not for purposes of limiting same, FIG. 3 shows a first exemplary embodiment of the invention 100 is mounted to a vehicle 300 utilizing a typical hitch receiver 310. Drum 200 is positioned over the invention.

FIG. 2 shows drum 201 in a non-deformed condition, whereas drum 200 (FIG. 3) is a typical condition where said invention would be generally useful. Drum 200 additionally indicates a generally flat or oval-shaped deformation. Drums 200 and 201 are shown without ballast bases secured. Most construction applications of drums require use of a ballast base. It is understood that any such ballast base that covers the open end of a channelizer drum is detached prior to use of the invention.

Placing the open-end of drum 200 over the invention will eventually contact a portion of the invention. Now referring to FIG. 1, drum 200 will contact a surface of the rigid reforming assembly 128, and potentially one or more of the cam-arm assemblies 129 which are connected to the central mast The cam-arm assemblies have upper ends 501 and lower ends 502. The upper ends are movable between a retracted position in which a deformed channelizer drum may be paced over them, and an extended position (FIG. 4) in which the upper ends 501 are further from the axis of the central mast 127 than when in the retracted position. Moreover, when in the extended position, plurality of arms 129 generally match the shape of an inner surface of a channelizer drum (FIG. 2). The rigid reforming assembly 128 and the cam-arm assemblies 129 are maintained in an extended and retracted mode by means for biasing the plurality of arms toward the retracted position, such as elastic cords 109 and 120. As a worker continues to apply force to the top of drum 200, the drum 200 will begin to reform due to the wedge-shape of the cam-arm assemblies 129 and the general drum-shape of the rigid reforming assembly 128. As noted above, a deformed drum 200 often takes a generally flat shape. It is generally easier to orientate the wider open-end of drum 200 with the rigid reforming assembly 128. Rigid reforming assembly has an outer perimeter conforming to the interior surface of a channelizer drum.

Figure 5:
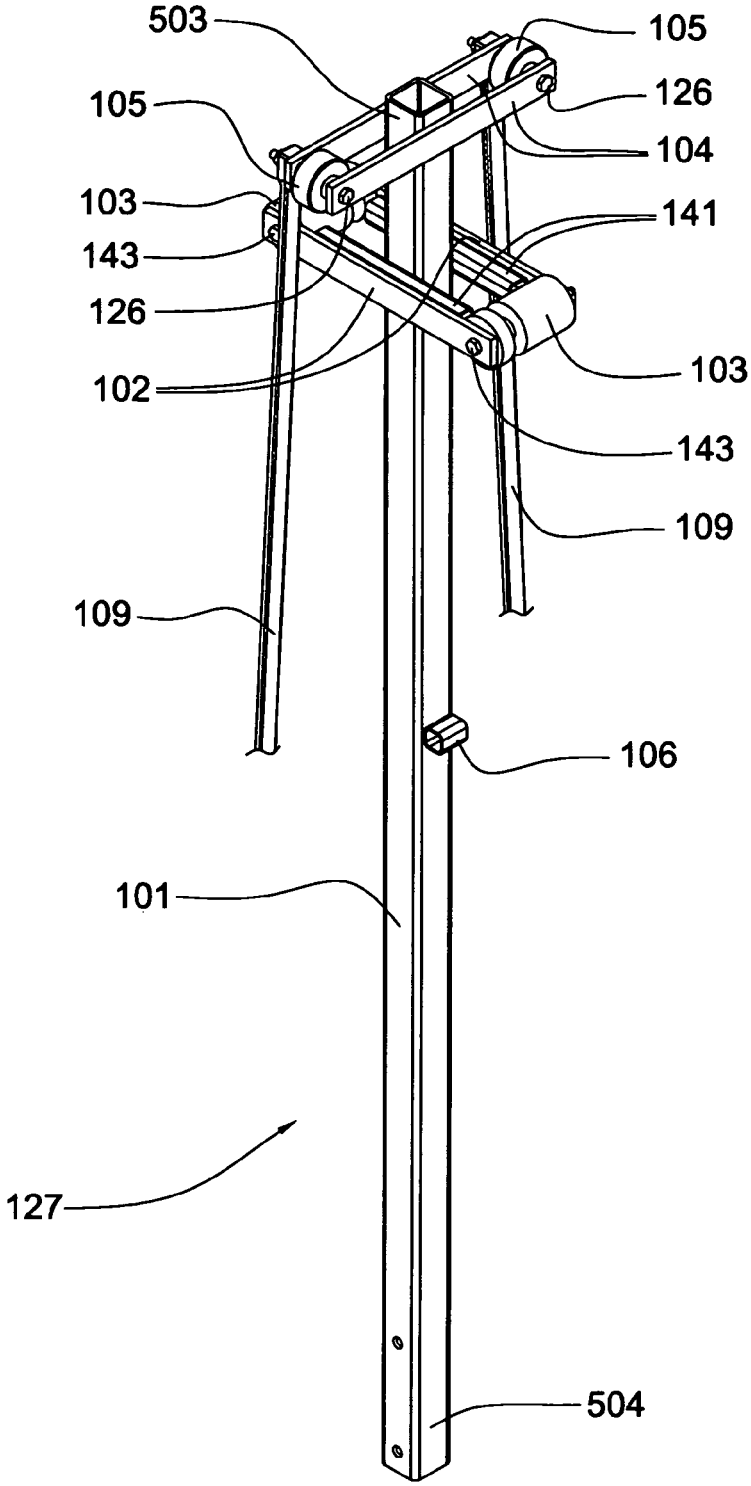
FIG. 5 illustrates a partial perspective view of first and second exemplary embodiments of the central mast according to the invention.

Continued applied force to the top of the drum 200 will begin to overcome the resistive forces of elastic cords 109 and 120 urging the rigid reforming assembly and attached cam-arm assemblies along a path generally defined by the central mast assembly 127 having an axis (FIG. 5). Rigid reforming assembly 128 is guided from a combination of sliding and rolling members. Narrow rollers 105 are guided along a path generally defined by the c-shaped guide rails 113. Low-friction guides 132 placed between roller guide 107 and guide mounting plates 136 is held in position from roller guide fasteners 133 guide the lower portion the rigid reforming assembly 128 along the central mast 101.

Downward movement of the rigid reforming assembly 128 along the central mast assembly 127 encourages the cam-arm assemblies 129 to expand outward along a path generally defined by the grooved rollers 103 and cam 117 (FIG. 8) from their retracted position to their extended position. The outward expansion of cam-arm assemblies 129 press against the interior surface of drum 200 encouraging it to take a generally cylindrical shape. Additionally, the tapered sides of the rigid reforming assembly 128 as defined by the outer frame member 110 encourage drum 200 to reform as it is pressed downward.

Continued downward movement of the rigid reforming assembly 128 along the central mast assembly 127 will eventually urge outer frame member 110 of the rigid reforming assembly 128 to contact the upper-most end of the central mast 101 of the central mast assembly 127. At this position, cam-arm assemblies 129 being at their greatest outward position.

If upon the greatest outward position (FIG. 4) of the cam-arm assemblies 129, drum 200 is not at a desired level of reforming, the process can be repeated. As the downward force is removed from the top of drum 200, elastic cords 109 and 120 will encourage the rigid reforming assembly 128 and cam-arm assemblies 129 to move upward and retract to its initial condition (FIG. 1) upon roller guide 107 contacting end-of-travel stop 106. If a deformed portion of drum 200 lie in a region that is not near a contact area of either the rigid reforming assembly 128 or cam-arm assemblies 129, then it may be beneficial to rotate the drum 200 relative to the invention such that a deformed portion is aligned with the rigid reforming assembly 128 or a cam-arm assembly 129 for the next reforming cycle.

FIG. 5 shows a perspective view of the central mast assembly 127, which has an upper end 503 and lower end 504. Narrow rollers 105 rotate about fasteners 126 and are inserted through plates 104 welded to central mast 101. Fasteners 126 additionally support upper ends of elastic cords 109. Grooved rollers 103 rotate about fasteners 143 and are inserted through plates 102 welded to spacer tubes 141 that are welded to central mast 101.

Figure 6:
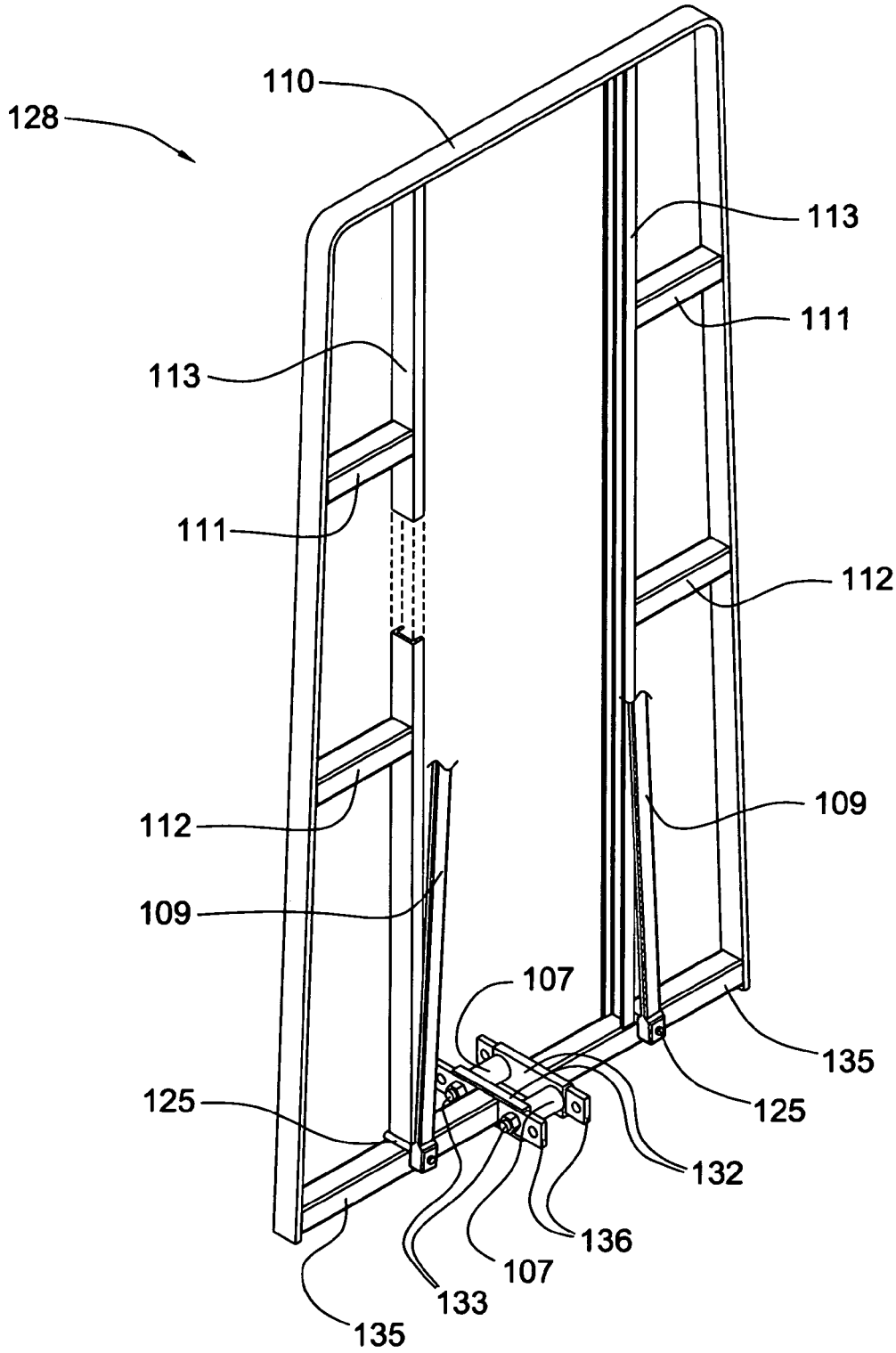
FIG. 6 illustrates a partial perspective view of first and second exemplary embodiments of the rigid reforming template according to the invention.

FIG. 6 shows a perspective view of the rigid reforming assembly 128. Outer frame member 110 approximates the inner profile of a typical drum 201. The strength of c-shaped guide rails 113 are enhanced by bracing tubes 111, 112 and lower frame member 135 which are joined to outer frame member 110. Joined to lower frame members 135 are guides plates 136 that allow a mounting position for cam-arm assemblies 129, low-friction guides 132, and roller guides 107 held in position by fasteners 133. Rods 125 attach to the lower end of elastic cords 109.

Figure 7:
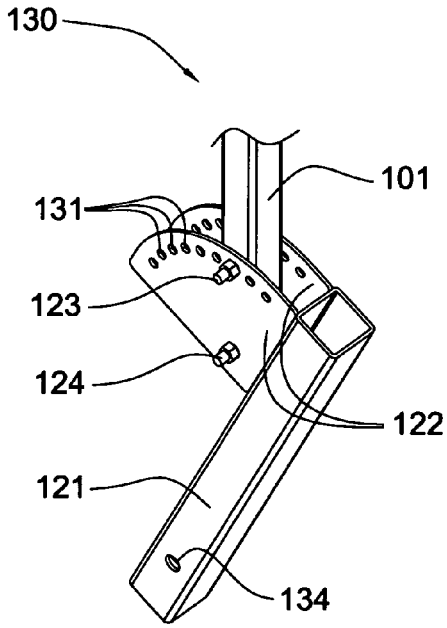
FIG. 7 illustrates a partial perspective view of first and second exemplary embodiments of an angularly adjustable mounting system according to the invention.

FIG. 7 shows a perspective view of pivot mount assembly 130. Central mast 101 is angularly adjustable about fastener 124 by positioning fastener 123 into a corresponding pair of holes 131 in angle adjuster plates 122. Adjuster plates 122 are secured to hitch adapter mount tube 121. Hitch adapter tube 121 can be in turn rigidly secured to a rigid structure such as vehicle 300 (FIG. 3) if when said vehicle utilizes a typical hitch receiver 310 and secured into the hitch receiver 310 with a hitch pin or equivalent through hole 134. Accordingly, the mounting assembly permits a selectable angular orientation of the apparatus with respect to the ground.

Figure 8:
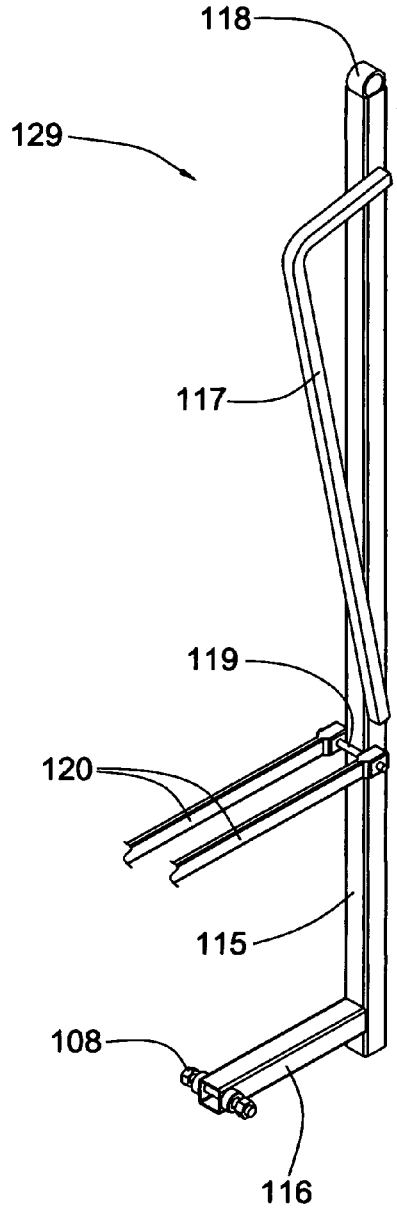
FIG. 8 illustrates a partial perspective view of first and second exemplary embodiments of an expanding arm according to the invention.

FIG. 8 shows a perspective view of cam-arm assembly 129. Cam arm assembly 129 pivots about fastener 108 mounted through guide plates 136 (FIG. 6). Fastener 108 is inserted through offset tube 116 secured to vertical arm tube 115. Vertical arm tube 115 is capped by a low-friction structure such as radius cap 118 reducing sliding forces to the channelizer drum 200 during reforming. Cam 117 engages grooved roller 103 and generally defines the rate at which the cam-arm assembly 129 extends outwardly as the rigid reforming assembly encouraged downward. Elastic cords 120 are attached to rods 119 urging continuous contact between cams 117 and grooved rollers 103.

Figure 9:
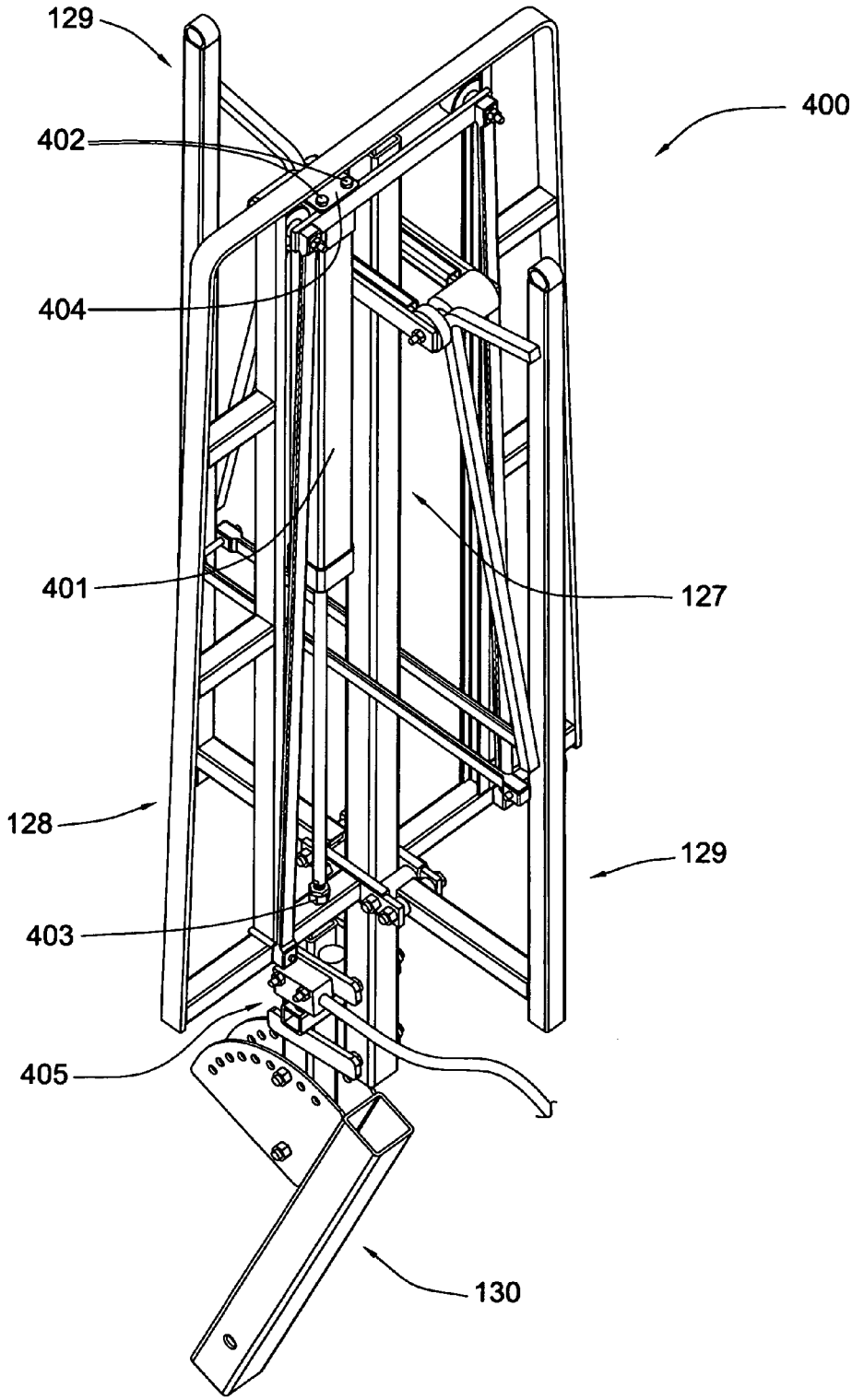
FIG. 9 illustrates a perspective view of a second exemplary embodiment including a power-assist system shown in an expanded mode as according to the invention.

FIG. 9 shows a perspective view of a second embodiment of a channelizer drum reformer 400. Channelizer drum reformer 400 is generally the same as channelizer drum reformer 100 with the addition of a power-assist system. Pneumatic cylinder 401 is mounted at one end by fasteners 402 through plate 404. The opposing end of pneumatic cylinder 401 is attached to nut 403 welded to lower frame member 135 of rigid reforming assembly 128. Power-assist valve system 405 mounts to central mast 101 of central mast assembly 127 and angle adjuster plates 122 of the pivot mount assembly 130. The powerized system moves the plurality of arms form their retracted position to their extended position.

Figure 10:
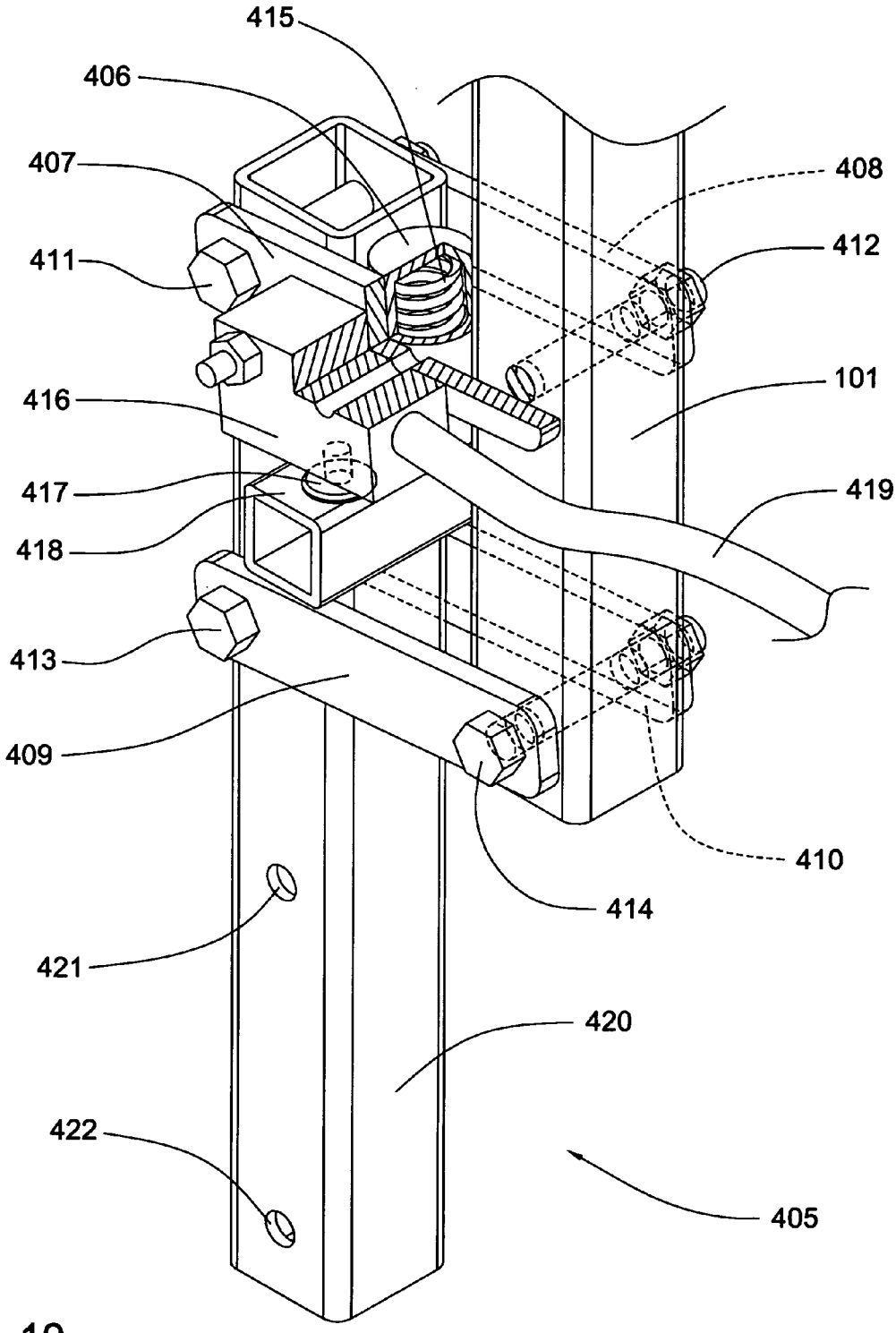
FIG. 10 illustrates a partial perspective view of a second exemplary embodiment detailing a power-assist valve system according to the invention.

FIG. 10 shows a partial perspective view of a second embodiment of a channelizer drum reformer 400 power-assist valve system 405. It is the function of the power-assist valve system 405 to provide a simple means by which to actuate pneumatic cylinder 401. Downward force applied on channelizer drum 200 is transmitted to the rigid reforming assembly 128. If when the force is substantial enough, elastic cords 109 and 120 extend and cam-arm assemblies 129 are urged outward, and at some point contact the interior of channelizer drum 200. This downward force on channelizer drum 200 is eventually transmitted to the central mast assembly 127 component central mast 101. Adjustable angle adapter tube 420 is mounted rigidly to pivot mount assembly 130 by fasteners inserted through holes 421 and 422. Compression spring 415 is contained in spring cup 406 at one end and contact tube 418 at the opposing end. Spring cup 406 and valve 416 are secured to pivot plate 407. Pivot plates 407, 408, 409 and 410 rotate about fasteners 411, 412, 413 and 414 urging central mast 101 and adjustable angle adapter tube 420 to maintain a generally parallel orientation. Depression of the button 417 allows flow of compressed air from supply hose 419 to pneumatic cylinder 401. When the power-assist valve system 405 is in equilibrium, valve 416 is not actuated and button 417 rests against contact tube 418. Downward applied force on channelizer drum 200 is eventually transmitted to compression spring 415. If the applied forces become great enough, compression spring 415 deflects and button 417 is depressed enabling flow of compressed air from supply hose 419 to pneumatic cylinder 401 urging it to extend. The extension of pneumatic cylinder 401 urges cam-arm assemblies outward against the interior of drum 200 aiding in the reforming process.

Figure 11:
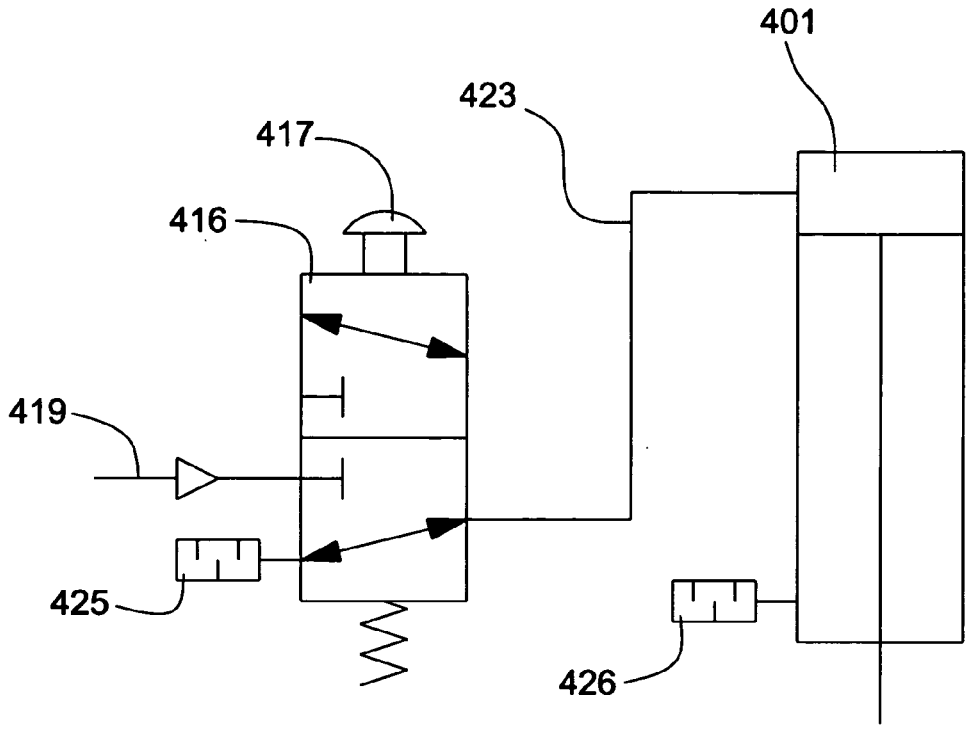
FIG. 11 is a pneumatic diagram of a second exemplary embodiment with a pneumatic power source available.

FIG. 11 is a pneumatic diagram of a second exemplary embodiment where a pneumatic power source 419 is available. Depression of button 417 allows compressed air to flow through hose 423 to cylinder 401 urging cylinder 401 to extend and urging air from the annular side of cylinder 401 through muffler 426 to atmosphere. Release of button 417 allows air flow through mufflers 425 and 426 as elastic cords 109 and 120 urge cylinder into a retracted position.

Figure 12:
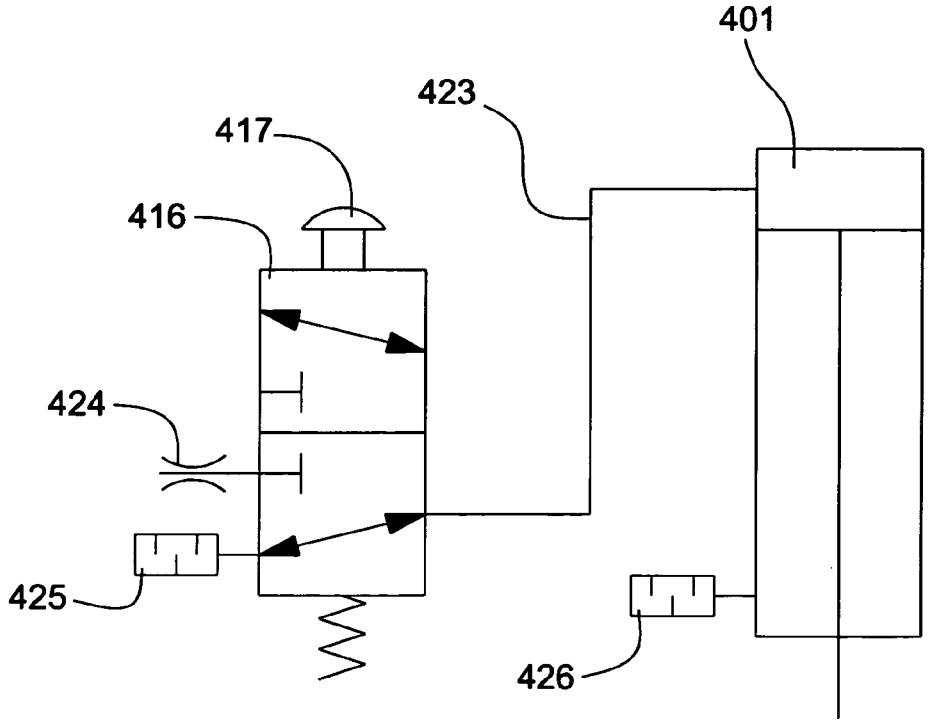
FIG. 12 is a pneumatic diagram of a second exemplary embodiment with a pneumatic power source unavailable.

FIG. 12 is a pneumatic diagram of a second exemplary embodiment where power source 419 is unavailable or has been disconnected from valve 416. Valve 416 is fitted with a typical male quick-disconnect fitting 424 that allows free-flow of air when disconnected and thereby allowing a generally free movement of cylinder 401.

Valve 416 is designed such that when button 417 is not depressed, air within pneumatic cylinder 401 can flow freely through the valve 416. Additionally, the annular cavity of pneumatic cylinder 401 is open to atmosphere. This pneumatic design enables the invention to function in a manual-mode when a compressed air supply is not available.

Figure 13:
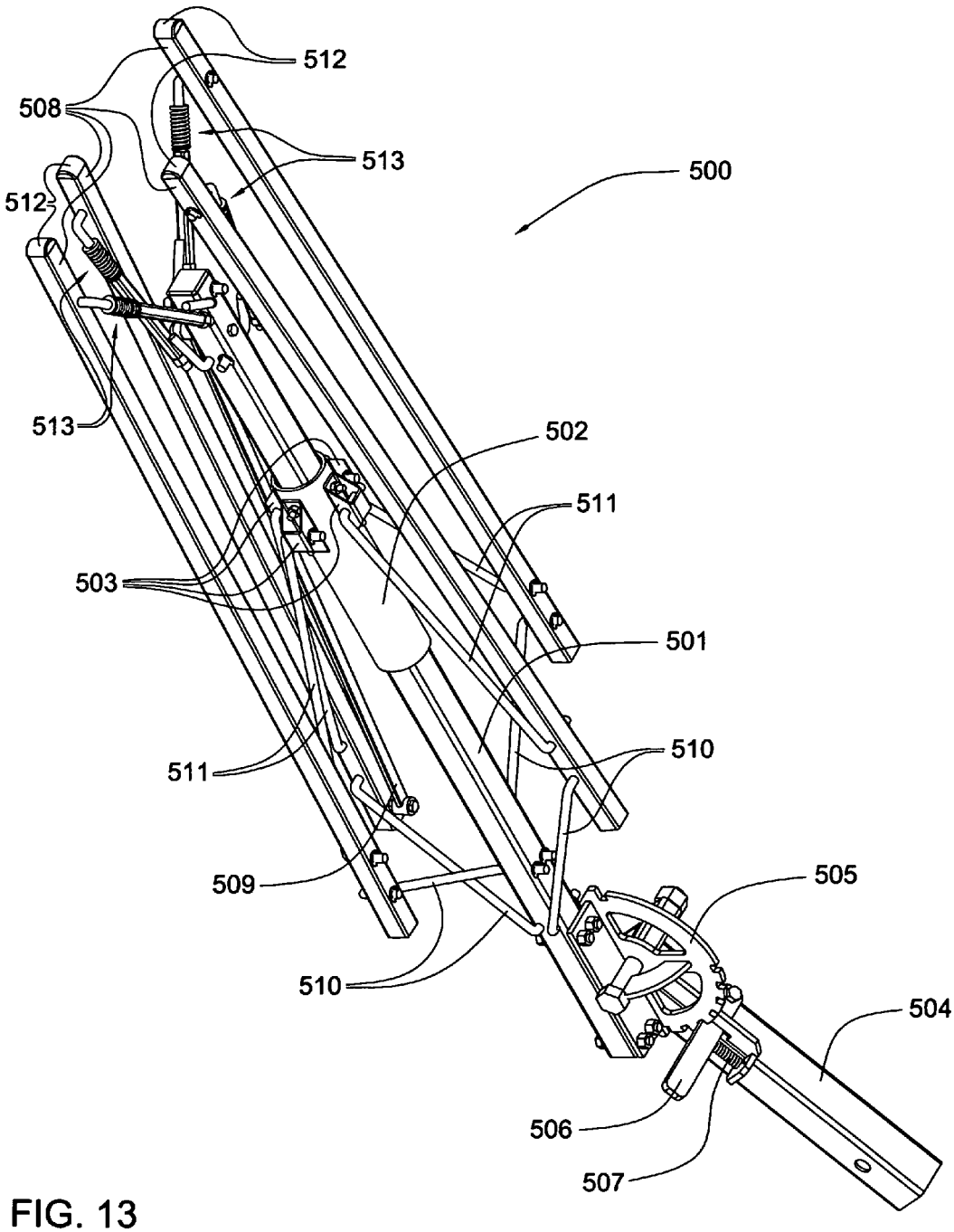
FIG. 13 illustrates a perspective view of a third exemplary embodiment shown in a retracted mode as according to the invention.

FIG. 13 shows a perspective view of a third embodiment of the channelizer drum reformer 500. Drum 200 is similarly positioned over the invention as described in the second embodiment of the invention and illustrated in FIG. 3. As drum 200 is lowered onto the invention until at least one expander arm 508 contacts an interior area of drum 200. Timing slide 502 is made of low-friction material and is contained by central mast 501. Timing slide 502, timing slide pivot 503, and middle linkage 511 urge each expander arm 508 to move in unison. Elastic cord 509 is attached to an expander arm 508 at one end and central mast 501 at the opposite end urging expander arm 508 in an upward and retracted position. Expander arm 508 moves in a path generally defined by upper compressible linkage 513 and lower linkage 510. It is intended that at full outward extension of linkages 513 and 510 that expander arms 508 approximate the maximum inside diameter of drum 201. Upper compressible linkage 513 allows for variations in drum diameters. Radius cap 512 attached to expander arm 508 reduced sliding forces between drum 200 and expander arm 508.

Continued downward force applied to drum 200 urges expander arms 508 in an outward direction encouraging reforming of drum 200. If upon the greatest outward position of the expander arms 508, drum 200 is not at a desired level of reforming, the process can be repeated. As the downward force is removed from the top of drum 200, elastic cord 509 encourage the all expander arms 508 to move upward and retract to their initial retracted positions. The drum can be reoriented to position expander arms 508 in a manner that will further encourage reforming upon the next cycle of expansion.

As described previously in the first embodiment of the invention, it is useful to adjust the height of the invention to accommodate various worker and mounting heights. Spring 507 urges arm 506 into notches of adjustable index plate 505. The angle of central mast 501 in relation to hitch adapter mount tube 504 is easily indexed by retracting arm 506 and positioning arm 506 into another notch.

Figure 14:
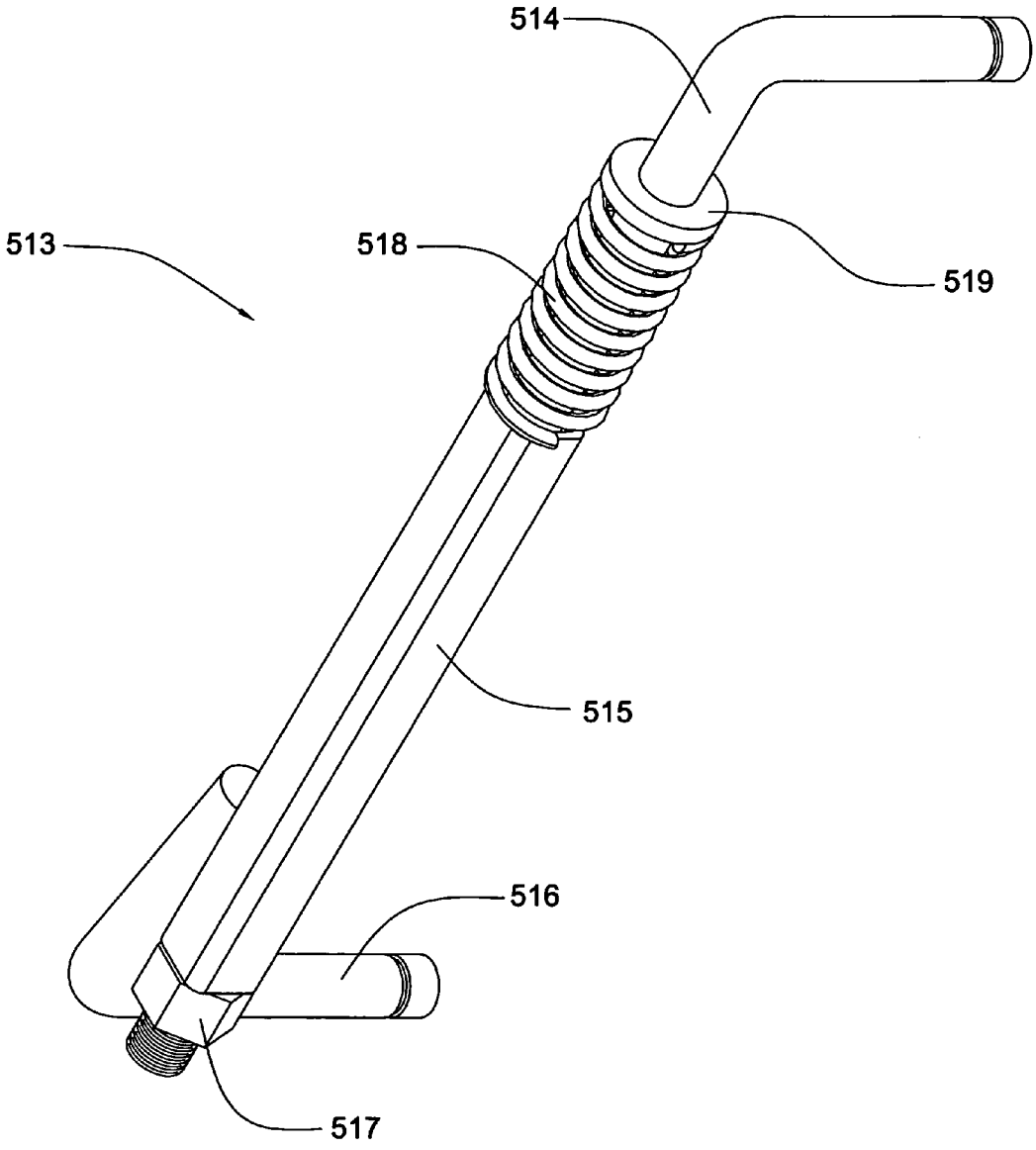
FIG. 14 illustrates a partial perspective view of a third exemplary embodiment of a compressible linkage assembly.

FIG. 14 shows a perspective view of compressible linkage 513. Slide linkage 514 inserted through square linkage tube 515. Compression spring 518 contacts linkage tube 515 at one end and spring cap 519 at the opposing end. Spring cap 519 is joined to slide linkage 514. Nut 517 is threaded on the lower end of slide linkage 514. Pivot 516 is joined to linkage tube 515.

Those of skill in the art will understand that various details of the invention may be changed without departing from the spirit and scope of the invention. Furthermore, the foregoing description is for illustration only, and not for the purpose of limitation, the invention being defined by the claims. For example, while the shown embodiment utilizes one movable arm, then invention could easily constructed using a single arm, along with a rigid-reforming structure, or with more than two arms, either with or without a rigid reforming structure.

All references cited in this specification are incorporated herein by reference to the extent that they supplement, explain, provide a background for or teach methodology or techniques employed herein.

I claim:

1. A channelizer drum reforming apparatus comprising:
a central mast having an axis;
a plurality of arms; each arm
being connected to the central mast and
having upper and lower ends,
the upper ends being movable between retracted and extended positions, such that
when in the retracted position a deformed channelizer drum may be placed over the arms; and
when in the extended position, the upper and lower ends are both further from the axis of the central mast than when in the retracted position, and such that the arms generally match the shape of an inner surface of the channelizer drum.

2. The channelizer drum reforming apparatus of claim 1 further comprising:
a mounting system for mounting the apparatus to a rigid structure.

3. The channelizer drum reforming apparatus of claim 2 wherein the mounting system permits a selectable angular orientation of the apparatus with respect to the ground.

4. The channelizer drum reforming apparatus of claim 1 wherein
the central mast has an upper end and a lower end; and
the arms are movable with respect to the axis of the mast, and move toward the extended position as the arms are moved toward the lower end of the mast.

5. The channelizer drum reforming apparatus of claim 4 further comprising:
A rigid reforming assembly having an outer perimeter conforming to the interior surface of a channelizer drum.

6. The channelizer drum reforming apparatus of claim 4 further comprising:
A powerized system for moving the plurality of arms from their retracted position to their extended position.

7. The channelizer drum reforming apparatus of claim 6 wherein the powerized system is actuated in response to movement of a channelizer drum toward the central mast.

8. The channelizer drum reforming apparatus of claim 1 wherein the upper ends of each arm are comprised of a low-friction structure.

9. The channelizer drum reforming apparatus of claim 1 further comprising:
Means for biasing the plurality of arms toward the retracted position.

10. A channelizer drum reforming apparatus comprising:
a central mast having an axis;
a rigid reforming assembly having an outer perimeter conforming to the interior surface of a channelizer drum;
at least one arm; each arm
being connected to the central mast and
having upper and lower ends,
the upper end(s) being movable between retracted and extended positions, such that
when in the retracted position a deformed channelizer drum may be placed over the arm(s); and
when in the extended position, the upper end(s) are further from the axis of the central mast than when in the retracted position, and such that the arm(s) generally match the shape of an inner surface of the channelizer drum.

11. A method for reforming a deformed channelizer drum apparatus comprising:
providing:
a central mast having an axis;
a plurality of arms; each arm
being connected to the central mast and
having upper and lower ends,
the upper ends being movable between retracted and extended positions, such that
when in the retracted position a deformed channelizer drum may be placed over the arms; and
when in the extended position, the upper ends are further from the axis of the central mast than when in the retracted position, and such that the arms generally match the shape of an inner surface of the channelizer drum;
placing a deformed channelizer drum over the plurality of arms in the retracted position;
moving the plurality of arms from their retracted position to the extended position to thereby reform the channelizer drum.

12. The method for reforming a deformed channelizer drum of claim 11 wherein
The step of moving the plurality of arms from their retracted position to the extended position is accomplished by pushing channelizer drum while on the plurality arms toward the central mast.

13. A channelizer drum reforming apparatus comprising:

a central mast having an axis, an upper end and a lower end;

a plurality of arms; each arm being connected to the central mast and having upper and lower ends, the upper ends being movable between retracted and extended positions, such that when in the retracted position a deformed channelizer drum may be placed over the arms; and when in the extended position, the upper ends are further from the axis of the central mast than when in the retracted position, and such that the arms generally match the shape of an inner surface of the channelizer drum and wherein the arms are movable with respect to the axis of the mast, and move toward the extended position as the arms are moved toward the lower end of the mast;

a powerized system for moving the plurality of arms from their retracted position to their extended position which is actuated in response to movement of a channelizer drum toward the central mast.

* * * * *